US006116420A

United States Patent [19]

Hall et al.

[11] Patent Number: 6,116,420

[45] Date of Patent: Sep. 12, 2000

[54] TOOTHPICK DISPENSER FOR REMOVING TOOTHPICKS INDIVIDUALLY

[76] Inventors: Glenn Raymond Hall, 278 Tarragindi Road, Moorooka, Queensland 4105; Peter Alan Cruse, 3 Smith Road, Park Ridge, Queensland, 4125, both of Australia

[21] Appl. No.: 09/077,014

[22] PCT Filed: Nov. 22, 1996

[86] PCT No.: PCT/AU96/00741

§ 371 Date: May 11, 1998

§ 102(e) Date: May 11, 1998

[87] PCT Pub. No.: WO97/18741

PCT Pub. Date: May 29, 1997

[30] Foreign Application Priority Data

Nov. 23, 1995 [AU] Australia ..... PN6738

[51] Int. Cl.[7] ..... B65D 85/24

[52] U.S. Cl. ..... 206/380; 206/443

[58] Field of Search ..... 206/380, 382, 206/443, 469

[56] References Cited

U.S. PATENT DOCUMENTS

| | | | |
|---|---|---|---|
| 1,819,451 | 8/1931 | Wissig | 206/382 |
| 1,856,559 | 5/1932 | Johnson | 206/380 |
| 2,897,962 | 8/1959 | Zackheim . | |
| 3,325,000 | 6/1967 | Edwards . | |
| 3,331,499 | 7/1967 | Jost | 206/380 |
| 3,371,775 | 3/1968 | Butler . | |
| 3,472,368 | 10/1969 | Hellstrom | 206/469 |
| 4,232,787 | 11/1980 | Holiday . | |
| 4,344,532 | 8/1982 | Eldridge, Jr. et al. . | |
| 4,488,393 | 12/1984 | dinh Can . | |
| 4,574,948 | 3/1986 | Huck et al. . | |
| 4,637,512 | 1/1987 | Smith . | |
| 4,832,194 | 5/1989 | Cheng . | |

FOREIGN PATENT DOCUMENTS

| | | |
|---|---|---|
| 52638/79 | 5/1981 | Australia . |
| 24206/84 | 8/1984 | Australia . |
| 16579/95 | 11/1995 | Australia . |
| 0 439 740 A1 | 8/1991 | European Pat. Off. . |

*Primary Examiner*—Jim Foster
*Attorney, Agent, or Firm*—Renner, Otto, Boisselle & Sklar

[57] ABSTRACT

A dispenser (10) for toothpicks, gum massages and the like can be carried in a pocket, wallet or purse and has a flat body portion (11) housing the tips of individually sealed toothpicks (13) and a plurality of finger portions (12) housing the base of each toothpick (13) the finger portions (12) being individually openable to allow individual removal of a toothpick without contamination of the other toothpicks.

14 Claims, 1 Drawing Sheet

TOOTHPICK DISPENSER FOR REMOVING TOOTHPICKS INDIVIDUALLY

FIELD OF THE INVENTION

This invention relates to a dispenser for toothpicks and particularly to a dispenser to allow toothpicks to be individually removed.

BACKGROUND ART

Dispensers for toothpicks or gum massagers, are usually of box type configuration where a large number (usually between 100 to 200) of toothpicks are placed in a box for sale. To obtain a toothpick, the box is opened and a person removes a toothpick therefrom. Due to the size of the toothpick, the person will usually touch at least 10 other toothpicks in trying to remove a single one from the box. A disadvantage with this system is that the toothpicks remaining in the box become contaminated which can lead to mouth infections. Also, dust can enter the box to contaminate the remaining toothpicks. A further disadvantage is that the toothpicks can prick a person's finger when being removed, and the toothpick tips are not protected from being touched or otherwise contaminated.

It is known to provide gum massagers in a matchbook form where approximately 50 gum massagers are provided which can be individually torn away from a base portion of the book. With this arrangement, the base of each gum massager is attached to the base portion of the book, and to remove a gum massager, a person must touch the tip of the gum massager. This in turn can contaminate the tip before being inserted into the person's mouth.

A further disadvantage with both the box container and the matchbook arrangement is that neither have provision to safely store a used toothpick or gum massager. Thus, it is currently necessary to discard the used toothpick, and the toothpick may contain saliva, food scraps and possibly bacterial contamination.

OBJECT OF THE INVENTION

It is an object of the invention to provide a dispenser which may overcome the abovementioned disadvantages or provide the consumer with a useful or commercial choice.

In one form the invention resides in a dispenser for toothpicks, the dispenser comprising a body portion in which a part of each toothpick is held, and at least one finger portion extending from the body portion, each finger portion holding an individual toothpick and being manually operable to allow the toothpick to be removed from the finger portion and the body portion.

The dispenser can be used for toothpicks and gum massagers.

The dispenser is typically sized and configured to allow it to be placed in a person's wallet or purse. The dispenser may be manufactured to be disposable, and to allow it to be used as a single use dispenser. It is envisaged that the dispenser will hold only a few toothpicks suitable for a single use. It is found that between 2 to 10 toothpicks, and typically about 5 toothpicks, can be provided in the dispenser.

The dispenser is typically substantially flat in configuration to allow it to be placed in a person's wallet, or purse, and also to make it relatively inconspicuous. The body portion may be substantially flat and may be rectangular when viewed in plan. To make the body portion substantially flat, the toothpicks held by the body portion are typically arranged in a single layer and in a side-by-side relationship.

The body portion may be of sufficient size to allow advertising to be applied thereto. It is also preferred that the body portion is not see-through so that the portion of the toothpicks in the body portion cannot be viewed.

The at least one finger portion may be substantially flat in configuration. Typically, the finger portions extend from adjacent one edge of the body portion. It is preferred that the finger portions are integrally formed with the body portion and cannot be completely removed from the body portion.

If a plurality of finger portions are provided, these may be in a side-by-side relationship relative to each other. The finger portions may also be removably attached to each other and this may be achieved by a line of perforations or a line of weakness between adjacent finger portions. By having the finger portions removably attached to each other, they can function to stiffen each other to minimise sag. Alternatively, the finger portions are separate from each other with the toothpick functioning as a stiffening member.

Each finger portion may include a blister in which a respective toothpick is located, and where the blister can be broken open to allow the toothpick to be removed from the finger portion and thus the body portion. The blister may provide a sterile environment for the toothpick.

The toothpicks may be arranged in the dispenser such that the tip of each toothpick is located within the body portion, and the base of the toothpick is located within the finger portion. In this arrangement, the finger portion can be opened and the toothpick can be removed without touching the tip of the toothpick.

A further advantage of the base portion/finger portion arrangement is that the tip area of a used toothpick can be re-inserted into the base portion to minimise contamination.

BRIEF DESCRIPTION OF THE DRAWINGS

An embodiment of the invention will be described with reference to the accompanying drawings in which.

BEST METHOD

Figure 1:
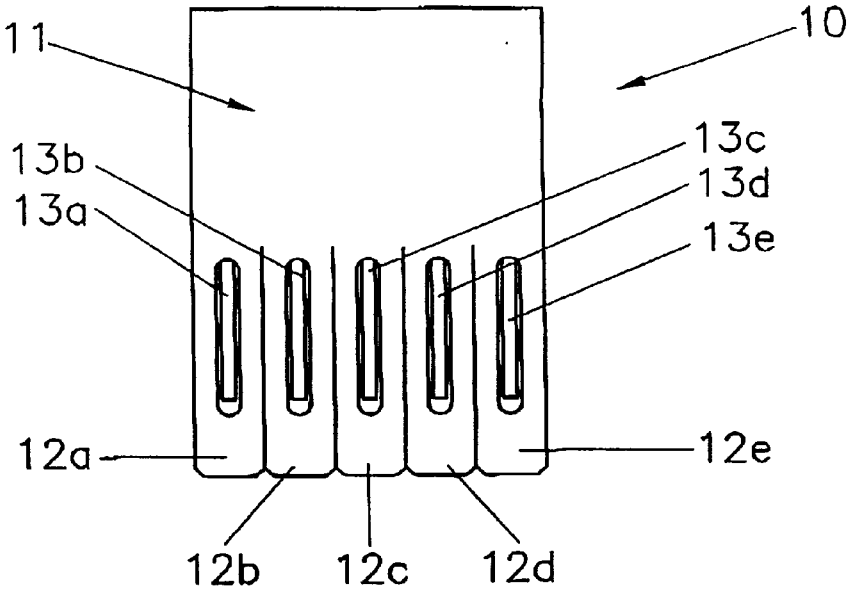
FIG. 1 is a plan view of a dispenser according to an embodiment of the invention.
Figure 2:
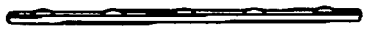
FIG. 2 is a end view of the dispenser of FIG. 1.

Referring to the drawings, there is disclosed a dispenser 10 to allow toothpicks to be individually removed therefrom. Dispenser 10 includes a body portion 11 and a plurality of finger portions 12A–12E. The dispenser 10 is substantially rectangular when viewed in plan, and is also substantially flat, having a thickness of between 2 mm to 4 mm. Body portion 11 is of a solid continuous design to allow advertising or other promotional material to be applied thereto. Also, by having body portion 11 of a non-see-through material, the tips of the toothpicks in the dispenser cannot be viewed. This is advantageous should a used toothpick be re-inserted into body portion 11.

Figure 4:
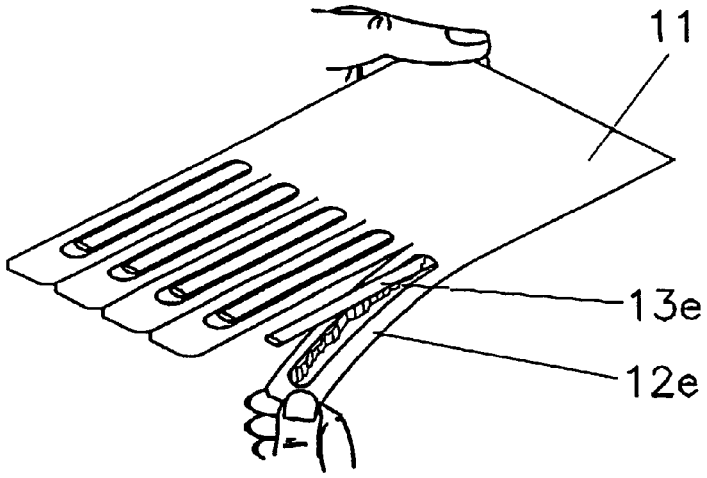
FIG. 4 is a view of the dispenser of FIG. 1 in use.

Finger portions 12A–12E extend outwardly from body portion and are in a side-by-side relationship with respect to each other. Each finger portion is integrally formed with body portion 11 and extends therefrom. Adjacent finger portions (i.e., 12D–12E), are removably attached to each other so that an individual finger portion (e.g., 12E) can be torn away from its adjacent finger portion 12D (see FIG. 4). This can achieved by having a line of perforations between adjacent finger portions. Alternatively, the finger portions (12A–12E) are separate from each other and are formed by running a cutting wheel between adjacent fingers. The toothpick in the finger portions functions to prevent sagging occurring.

Figure 3:
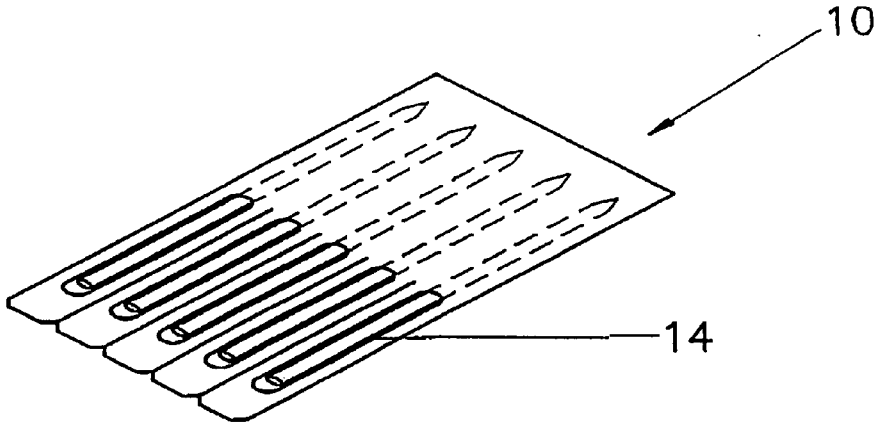
FIG. 3 is a perspective view of the dispenser of FIG. 1.

Each finger portion contains a toothpick 13A–13E. The toothpicks are arranged such that the tip area of each toothpick is located within the body portion as shown in phantom in FIG. 3. With this arrangement, the toothpick tips cannot be touched or otherwise contaminated when being removed from the dispenser. The base portion of each toothpick extends into a respective finger portion, and the finger portion is provided with a blister 14, typically of a see-through plastic, which can be broken to allow the toothpick to be removed. The blister and finger portion provides a sterile environment for the toothpick before use.

To remove the toothpick, the dispenser 10 is held in one hand, and a respective finger portion (see 12E in FIG. 4) is bent downwardly with the other hand. During this movement, the blister bursts to expose the base area of toothpick 13E. The toothpick can then be removed from body portion 11 and used. The used toothpick can then be re-inserted into body portion 11 so that the used and contaminated tip is safely housed for disposal.

It can be seen that the remainder of the toothpicks are not touched or otherwise contaminated when one of the toothpicks is removed. Also, the dispenser dispenses toothpicks in a manner such that the tip area cannot be touched and contaminated, and also allows a used contaminated toothpick to be re-inserted into the dispenser without contaminating the remaining toothpicks.

It should be appreciated that various other changes and modifications may be made to the embodiment described without departing from the spirit and scope of the invention.

We claim:

1. A toothpick dispenser for dispensing a plurality of individually sealed toothpicks, the dispenser having a body portion in which a part of each toothpick is held, and at least one finger portion, each finger portion having a base portion and an upper breakable portion and which extends from the body portion, each finger portion holding an individual toothpick and being able to be pulled downwards such that the finger portion is pulled away from any adjacent finger portion whilst remaining attached to the body portion thereby causing the toothpick to break the breakable portion to allow the toothpick to be removed from the finger portion and the body portion.

2. The dispenser of claim 1, wherein the body portion and the finger portions are flat and the toothpicks are in a side by side relationship.

3. The dispenser of claim 2, wherein the body portion is opaque and is of sufficient size to allow advertising to be applied thereto.

4. The dispenser of claim 2, wherein a plurality of side by side finger portions are provided extending from adjacent one edge of the body portion.

5. The dispenser of claim 4, wherein the finger portions are integrally formed with the body portion.

6. The dispenser of claim 5, wherein adjacent finger portions are removably attached to each other.

7. The dispenser of claim 6, wherein the adjacent finger portions are removably attached to each other by a line of weakness between adjacent finger portions.

8. The dispenser of claim 7, wherein each finger portion has a blister in which a respective toothpick is located and where the blister can be broken open when the finger portion is pulled downwards to allow the toothpick to be removed from the finger portion and thus the body portion.

9. The dispenser of claim 8, wherein the toothpicks are arranged in the dispenser such that the tip of each toothpick is located within the body portion, and the base of the toothpick is located within the finger portion wherein the finger portion can be opened and the toothpick can be removed without touching the tip of the toothpick.

10. The dispenser of claim 9, wherein the tip area of a used toothpick can be re-inserted into the base portion to minimise contamination.

11. The dispenser of claim 4, wherein the finger portions are separate from each other.

12. A toothpick dispenser comprising a flat main body portion formed from at least two overlapping sheet members, a plurality of toothpicks in a spaced side by side relationship and having their tips positioned between the sheet members with the sheet members being attached to each other to form individual sealed areas for each toothpick, a plurality of flat finger portions extending from one edge of the body portion, each finger portion having a base portion and an upper breakable portion which supports the remainder of a said toothpick, adjacent finger portions being removably attached to each other, whereby to remove an individually sealed toothpick, the body portion is held and a said finger portion is pulled downwards away from adjacent finger portions whilst remaining attached to the body portion thereby causing the base of the toothpick to break the breakable portion, thereby allowing the toothpick to be removed by its base.

13. A toothpick dispenser comprising a flat main body portion formed from at least two overlapping sheet members, a plurality of toothpicks in a spaced side by side relationship each toothpick having an end positioned between the sheet members with the sheet members being attached to each other to form individual sealed areas for each toothpick, a plurality of flat finger portions extending from one edge of the body portion, each finger portion having a base portion and an upper breakable portion which supports the remainder of a said toothpick, whereby to remove an individually sealed toothpick, the body portion is held and a said finger portion is pulled downwards away from adjacent finger portions whilst remaining attached to the body portion thereby allowing the toothpick to be removed from the dispenser.

14. A toothpick dispenser comprising a body portion, a plurality of individually sealed toothpicks in a spaced side by side relationship, each toothpick having an end positioned within the body portion, a plurality of flat finger portions extending from one edge of the body portion, each finger portion having a base portion and an upper breakable portion which supports the remainder of a said toothpick, whereby to remove an individually sealed toothpick, the body portion is held and a said finger portion is pulled downwards away from adjacent finger portions whilst remaining attached to the body portion thereby causing the base of the toothpick to break the breakable portion, thereby allowing the toothpick to be removed from the dispenser.

* * * * *